US005361793A

United States Patent [19]

Stahnke

[11] Patent Number: 5,361,793

[45] Date of Patent: Nov. 8, 1994

[54] GOLF BALL WALKING STICK

[76] Inventor: Richard E. Stahnke, 303 Woodhaven Dr., Havelock, N.C. 28532

[21] Appl. No.: 60,161

[22] Filed: May 7, 1993

[51] Int. Cl.[5] ..... A45B 1/00

[52] U.S. Cl. ..... 135/65; 135/76; D3/14; D3/6

[58] Field of Search ..... 135/65 OR, 66, 76; D3/7, 14, 6

[56] References Cited

U.S. PATENT DOCUMENTS

| | | | |
|---|---|---|---|
| D. 261,539 | 10/1981 | Smith | D3/7 |
| 432,940 | 7/1890 | Headly | 135/65 |
| 566,306 | 8/1896 | Coldsmith | 135/76 |
| 884,041 | 4/1908 | Post | 135/76 |
| 4,796,648 | 1/1989 | Goulter | 135/65 |
| 5,033,241 | 7/1991 | Max | 52/390 |

FOREIGN PATENT DOCUMENTS

| | | | |
|---|---|---|---|
| 0008984 | 5/1928 | Australia | 135/76 |
| 0406090 | 1/1910 | France | 135/76 |
| 0438350 | 5/1912 | France | 135/76 |
| 0172743 | 1/1906 | Germany | 135/76 |
| 0396356 | 5/1924 | Germany | 135/76 |
| 0547613 | 9/1956 | Italy | 135/76 |
| 126477 | 12/1901 | Switzerland | 135/76 |
| 0250790 | 8/1948 | Switzerland | 135/76 |
| 0000870 | 3/1862 | United Kingdom | 135/76 |

*Primary Examiner*—Carl D. Friedman
*Assistant Examiner*—Wynn E. Wood
*Attorney, Agent, or Firm*—Olive & Olive

[57] ABSTRACT

A walking stick having a natural wood stick shaft and a handle formed of a golf ball. The golf ball may be attached to the shaft of the stick by means of a double-ended bolt.

2 Claims, 1 Drawing Sheet

GOLF BALL WALKING STICK

BACKGROUND OF THE INVENTION

1. Field of the Invention

This invention relates to walking sticks and, more particularly, to a walking stick having a golf ball substituted for a handle.

2. Description of Related Art

Several types of walking sticks made of natural or synthetic material are available. Generally the design of the available walking sticks is based on consideration of comfort to the user. Therefore different types of materials are used to provide different levels of strength and weight. In some cases, attention is given to the shape of the handle to provide sufficient "grip" but generally, the handle does not have the capability of being tailored for the particular person who is to use the walking stick.

The walking stick of this invention provides an enhanced grip. It is also an advantage of the invention that it provides for a walking stick which is comfortable to the user.

Another advantage of the invention is that it provides for a walking stick which supports the user physically.

Yet another advantage of the invention is that it provides for a walking stick capable of accepting a handle which is of special value to the particular user.

Other objects and advantages will be more fully apparent from the following disclosure and appended claims.

SUMMARY OF THE INVENTION

The walking stick of the invention is generally constructed of a shaft and a handle. The shaft may be constructed of an appropriate material, preferably a natural wooden stick, to provide for the desired strength, weight and appearance. A golf ball is provided for a handle. This may be any golf ball, but is preferably a golf ball for which the user has special sentiments, for example, the golf ball used in a winning tournament. In addition, the structure of the handle provides for enhanced grip.

DETAILED DESCRIPTION OF THE INVENTION AND PREFERRED EMBODIMENTS THEREOF

Figure 1:
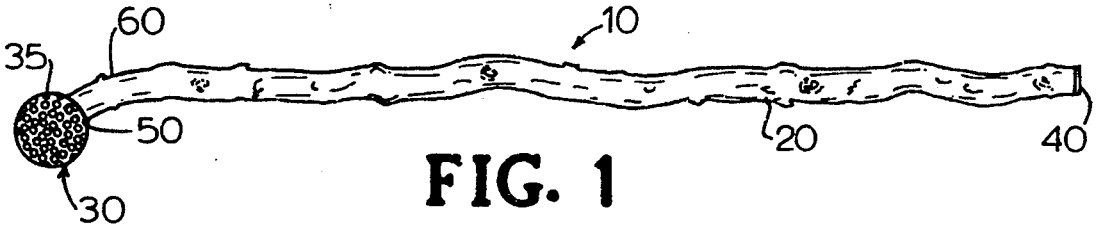
FIG. 1 is a perspective view of the walking stick of the invention.

Walking stick 10 is generally shown in FIG. 1. Shaft 20 may be made of any material which provides the desired strength, weight and appearance of a walking stick. Preferably shaft 20 is a portion of a natural stick; in other words, it is preferably a relatively long narrow portion of a woody part of a tree or shrub. Thus, the term "natural stick" as used herein refers, for example, to a cut tree branch or the trunk of a sapling having a diameter of a standard walking stick, for example, ¾ inch to about 1½ inches, which retains its bark, and may have protruding branch stumps, attached lichens, and other natural irregularities. Most preferably the natural stick has not been planed or sanded or otherwise smoothed or shaped. The natural stick generally has most or all of any protruding branches removed, for example, by a saw.

A preferred natural stick is made of oak or other hardwood of similar strength. The stick may be gently tapered from wider at the hand-held end to slightly narrower at the lower end, or may be generally of the same diameter for all or most of its length.

To maximize the strength of the shaft 20, it is best to use wood cut from a live tree in the winter when the sap is not running, and to dry the wood naturally or using means known in the art which do not adversely affect the wood, before finishing the walking stick.

A preferred walking stick 10 of the invention utilizes a shaft 20 which has been carefully chosen for its strength, for its feel as a walking stick and for its particular unique appearance or character by or for the person who is to be the user of the walking stick. The walking stick 10 can be further adorned, for example, with carvings or other personalized markings as desired.

To protect the wood, and provide an improved appearance and feel in use, the natural stick is preferably coated with a finish, such as a polyurethane which may include a natural wood stain. Such a coating does not obscure the natural variations in color and texture of the bark, branch ends or branch stumps, lichens and the like which make up the exterior surface of the preferred shaft 20.

In the first preferred embodiment, shaft 20 is selected to have slight curve 60, as generally shown in FIG. 1. In a second embodiment shaft 20 is generally straight throughout its entire length as shown for the relevant portion in FIG. 3. Shaft 20 may be any standard walking stick length, for example, about 3 feet for a short walking stick and extending up to about 5 feet or greater for a long walking stick.

Golf ball 30 is secured to shaft 20 at end 50, and is utilized as a handle. Dimples 35 of golf ball 30 provide additional grip. The golf ball 30 may be chosen for its significance to the person for whom the walking stick 10 is made, for example, the ball used for a particularly noteworthy golf game. The golf ball 30 may also be colored, for example, a pink ball for a woman owner, or otherwise decorated or labeled if desired.

Figure 2:
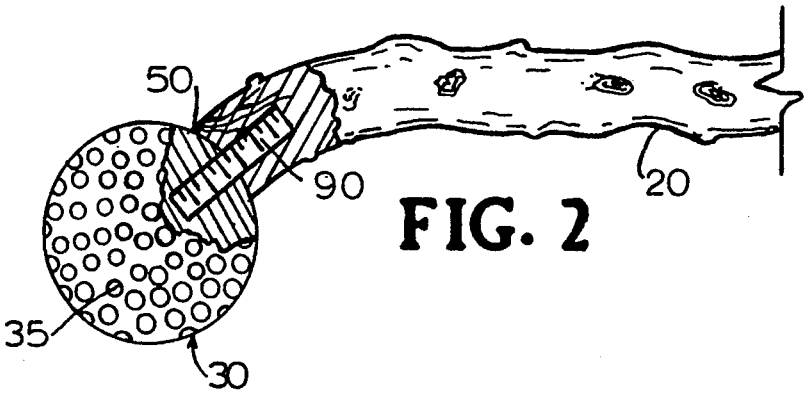
FIG. 2 is a sectional view of the walking stick of the invention showing the handle-to-shaft connection configuration.

Golf ball 30 may be secured to shaft 20 by any suitable means. In the preferred embodiments, golf ball 30 is secured to shaft 20 by means of double ended bolt 90 as shown in FIG. 2. A first end of bolt 90 is screwed into the end of shaft 20 and a second end of bolt 90 is screwed into golf ball 30. The threaded double ended bolt remains securely fastened to both the golf ball 30 and the shaft 20, as any appropriate turning pressure on the golf ball attached to the shaft 20 simultaneously keeps both ends of the bolt firmly screwed into the golf ball 30 and shaft 20, respectively.

Figure 3:
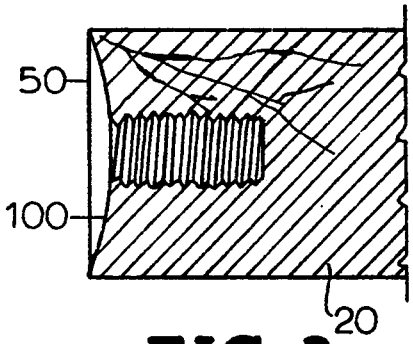
FIG. 3 is a sectional view of the upper part of the shaft of the walking stick of the invention, as it would appear on a straight shaft embodiment.

In order to provide for a secure fit between golf ball 30 and shaft 20, the surface of end 50 of shaft 20 may be inwardly curved as demonstrated in FIG. 3 by line 100. Curve 100 is calculated to be a portion of a circle having the same diameter as that of golf ball 30.

The golf ball walking stick 10 of the invention is particularly useful for outdoors walking, especially on and around a golf course. If the golf ball walking stick 10 is to be used indoors or on smooth surfaces, an endpiece made of rubber or other material may be secured to the lower portion of shaft 20 to prevent skid and lower the noise level when the walking stick 10 is used.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What is claimed is:

1. A walking stick comprising:

an elongate natural stick shaft having bark, stump and other natural irregularities retained thereon, having a diameter of approximately $\frac{3}{4}$ to $1\frac{1}{2}$ inch, and having a lower end and an upper end;

a golf ball releasably attached to said upper end;

a double ended bolt connected to said golf ball, said bolt being screwable into said upper end for releasable attachment thereto; and a polyurethane coat on the exterior surface of said shaft.

2. A walking stick as recited in claim 1, wherein said upper end is indented to form a portion of a spherical indentation having a curvature of a sphere having the same diameter as said golf ball.

* * * * *